US009291139B2

(12) United States Patent
Hicks et al.

(10) Patent No.: US 9,291,139 B2
(45) Date of Patent: Mar. 22, 2016

(54) DUAL ACTION FUEL INJECTION NOZZLE

(75) Inventors: Paul G. Hicks, Holland, MI (US); Fei Philip Lee, Holland, MI (US)

(73) Assignee: Woodward, Inc., Fort Collins, CO (US)

( * ) Notice: Subject to any disclaimer, the term of this patent is extended or adjusted under 35 U.S.C. 154(b) by 1984 days.

(21) Appl. No.: 12/199,404

(22) Filed: Aug. 27, 2008

(65) Prior Publication Data

US 2010/0051724 A1 Mar. 4, 2010

(51) Int. Cl.

| | |
|---|---|
| ***F02M 61/00*** | (2006.01) |
| ***F02M 61/16*** | (2006.01) |
| ***F02M 67/02*** | (2006.01) |
| ***F02M 53/04*** | (2006.01) |
| ***F02M 67/10*** | (2006.01) |
| ***F23D 11/10*** | (2006.01) |

(52) U.S. Cl.

CPC ..... *F02M 61/162* (2013.01); *F02M 53/043* (2013.01); *F02M 67/02* (2013.01); *F02M 67/10* (2013.01); *F23D 11/103* (2013.01)

(58) Field of Classification Search

CPC ... F02M 61/162; F02M 53/043; F02M 67/02; F02M 67/10; F23D 11/03

USPC ..... 239/399–406, 407, 416.5, 466, 491, 239/533.12

See application file for complete search history.

(56) References Cited

U.S. PATENT DOCUMENTS

| | | | | |
|---|---|---|---|---|
| 3,985,301 | A * | 10/1976 | Tindall | 239/126 |
| 4,095,418 | A * | 6/1978 | Mansson et al. | 60/39.094 |
| 4,216,652 | A | 8/1980 | Herman et al. | |
| 4,269,153 | A | 5/1981 | Kunii et al. | |
| 4,292,947 | A | 10/1981 | Tanasawa et al. | |
| 4,313,410 | A | 2/1982 | Kunii et al. | |
| 4,356,801 | A | 11/1982 | Graham | |
| 4,365,753 | A | 12/1982 | Harding et al. | |
| 4,387,677 | A | 6/1983 | Guerrier | |
| 4,434,766 | A | 3/1984 | Matsuoka et al. | |
| 4,455,982 | A | 6/1984 | Hafner et al. | |
| 4,519,370 | A | 5/1985 | Iwata | |
| 4,524,748 | A | 6/1985 | Giannotti | |
| 4,569,484 | A | 2/1986 | Phatak | |
| 4,570,598 | A | 2/1986 | Samson et al. | |
| 4,612,903 | A | 9/1986 | Urabe et al. | |
| 4,628,890 | A | 12/1986 | Freeman | |
| 4,633,830 | A | 1/1987 | Oshima et al. | |
| 4,662,179 | A | 5/1987 | Stratton | |
| 4,711,397 | A | 12/1987 | Lahiff | |
| 4,726,933 | A | 2/1988 | Mayr et al. | |
| 4,730,453 | A | 3/1988 | Benoist et al. | |

(Continued)

FOREIGN PATENT DOCUMENTS

| | | | |
|---|---|---|---|
| EP | 1 020 639 | A2 | 7/2000 |
| JP | 2007-046886 | A | 2/2007 |

*Primary Examiner* — Jason Boeckmann

(74) *Attorney, Agent, or Firm* — Reinhart Boerner Van Deuren P.C.

(57) ABSTRACT

The disclosure provides a fuel injection nozzle. The fuel injection nozzle includes a nozzle body, with the nozzle body defining a central bore. A fuel atomizer is disposed in the central bore. The fuel atomizer defines a spill-return bore and a swirl chamber. The swirl chamber is in fluid communication with the central bore. The spill-return bore includes a return swirler approximate the swirl chamber. An air supply pump is coupled to the fuel atomizer and is in fluid communication with the spill-return bore. The air supply pump is configured to selectively inject air into the swirl chamber through the spill-return bore.

23 Claims, 1 Drawing Sheet

(56) References Cited

U.S. PATENT DOCUMENTS

| | | | | |
|---|---|---|---|---|
| 4,763,481 | A | 8/1988 | Cannon | |
| 4,805,837 | A | 2/1989 | Brooks et al. | |
| 4,835,962 | A | 6/1989 | Rutter | |
| 4,842,197 | A | 6/1989 | Simon et al. | |
| 4,852,526 | A | 8/1989 | Brown | |
| 4,857,075 | A * | 8/1989 | Lipp | 48/86 R |
| 4,861,459 | A | 8/1989 | Cetinkaya | |
| 4,869,429 | A | 9/1989 | Brooks et al. | |
| 4,884,573 | A | 12/1989 | Wijay et al. | |
| 4,921,483 | A | 5/1990 | Wijay et al. | |
| 4,945,877 | A | 8/1990 | Ziegler et al. | |
| 4,982,902 | A | 1/1991 | Knapp et al. | |
| 5,009,589 | A | 4/1991 | Shekleton et al. | |
| 5,017,343 | A | 5/1991 | Cetinkaya | |
| 5,035,358 | A * | 7/1991 | Katsuno et al. | 239/403 |
| 5,080,060 | A | 1/1992 | Huang et al. | |
| 5,085,369 | A | 2/1992 | Aoki et al. | |
| 5,097,657 | A | 3/1992 | Shekleton et al. | |
| 5,168,839 | A | 12/1992 | Hitomi et al. | |
| 5,172,545 | A | 12/1992 | Forestier | |
| 5,173,175 | A | 12/1992 | Steffens et al. | |
| 5,188,805 | A | 2/1993 | Sabottke | |
| 5,201,295 | A | 4/1993 | Kimberley et al. | |
| 5,203,538 | A | 4/1993 | Matsunaga et al. | |
| 5,220,900 | A | 6/1993 | Wakeman | |
| 5,241,818 | A | 9/1993 | Shekleton et al. | |
| 5,241,935 | A | 9/1993 | Beck et al. | |
| 5,242,118 | A | 9/1993 | Schmidt et al. | |
| 5,263,316 | A | 11/1993 | Shekleton | |
| 5,271,563 | A | 12/1993 | Cerny et al. | |
| 5,289,627 | A | 3/1994 | Cerny et al. | |
| 5,341,783 | A | 8/1994 | Beck et al. | |
| 5,383,597 | A | 1/1995 | Sooriakumar et al. | |
| 5,400,970 | A | 3/1995 | Alt et al. | |
| 5,449,114 | A | 9/1995 | Wells et al. | |
| 5,465,701 | A | 11/1995 | Hunt | |
| 5,482,023 | A | 1/1996 | Hunt et al. | |
| 5,505,193 | A | 4/1996 | Ballini et al. | |
| 5,509,397 | A | 4/1996 | Hoshi | |
| 5,515,681 | A | 5/1996 | DeFreitas | |
| 5,551,391 | A | 9/1996 | Beck et al. | |
| 5,588,299 | A | 12/1996 | DeFreitas | |
| 5,590,517 | A | 1/1997 | DeFreitas | |
| 5,609,297 | A | 3/1997 | Gladigow et al. | |
| 5,626,292 | A | 5/1997 | Armaroli et al. | |
| 5,628,180 | A | 5/1997 | DeFreitas | |
| 5,647,536 | A | 7/1997 | Yen et al. | |
| 5,649,530 | A | 7/1997 | Ballini | |
| 5,713,205 | A | 2/1998 | Sciocchetti et al. | |
| 5,730,367 | A | 3/1998 | Pace et al. | |
| 5,765,750 | A | 6/1998 | Pace et al. | |
| 5,769,319 | A | 6/1998 | Yen et al. | |
| 5,787,860 | A | 8/1998 | Geels et al. | |
| 5,809,972 | A | 9/1998 | Grant | |
| 5,810,264 | A | 9/1998 | Yost | |
| RE36,070 | E | 2/1999 | Ballini et al. | |
| 5,899,389 | A | 5/1999 | Pataki et al. | |
| 5,921,474 | A | 7/1999 | Zimmerman et al. | |
| 5,931,123 | A | 8/1999 | Firey | |
| 5,934,555 | A * | 8/1999 | Dobbeling et al. | 239/11 |
| 6,024,301 | A | 2/2000 | Hurley et al. | |
| 6,029,913 | A | 2/2000 | Stroia et al. | |
| 6,032,652 | A | 3/2000 | Nozawa et al. | |
| 6,045,063 | A | 4/2000 | Koike et al. | |
| 6,093,310 | A | 7/2000 | Swan | |
| 6,102,299 | A | 8/2000 | Pace et al. | |
| 6,109,247 | A | 8/2000 | Hunt | |
| 6,209,806 | B1 | 4/2001 | Pace et al. | |
| 6,234,153 | B1 | 5/2001 | DeGroot et al. | |
| 6,270,024 | B1 | 8/2001 | Popp | |
| 6,308,687 | B1 | 10/2001 | Nagano et al. | |
| 6,311,900 | B1 | 11/2001 | Slowik et al. | |
| 6,334,427 | B1 | 1/2002 | Nakayama et al. | |
| 6,349,682 | B1 | 2/2002 | Alexius et al. | |
| 6,431,146 | B1 | 8/2002 | Alexius et al. | |
| 6,513,724 | B1 | 2/2003 | Joseph et al. | |
| 6,543,412 | B2 | 4/2003 | Amou et al. | |
| 6,557,521 | B2 | 5/2003 | Ichihara et al. | |
| 6,572,028 | B1 | 6/2003 | Fly et al. | |
| 6,575,247 | B2 | 6/2003 | Tolman et al. | |
| 6,672,106 | B1 | 1/2004 | Hawtof et al. | |
| 6,702,194 | B2 | 3/2004 | Nakayama et al. | |
| 6,718,960 | B2 | 4/2004 | Someno et al. | |
| 6,736,103 | B2 | 5/2004 | Hunt et al. | |
| 6,752,114 | B2 | 6/2004 | Ochiai et al. | |
| 6,779,743 | B2 | 8/2004 | Kitamura | |
| 6,789,754 | B2 | 9/2004 | Peterson, Jr. | |
| 6,830,029 | B2 | 12/2004 | Katayama | |
| 6,854,670 | B2 | 2/2005 | Sumisha et al. | |
| 6,869,032 | B2 | 3/2005 | Maier et al. | |
| 6,899,290 | B2 | 5/2005 | Varble et al. | |
| 6,908,050 | B2 | 6/2005 | Sekine et al. | |
| 6,913,004 | B2 | 7/2005 | Pellizzari et al. | |
| 6,915,968 | B2 | 7/2005 | Abe et al. | |
| 6,922,987 | B2 | 8/2005 | Mital et al. | |
| 6,929,197 | B2 | 8/2005 | Peterson, Jr. | |
| 6,945,480 | B2 | 9/2005 | Pfrommer et al. | |
| 6,983,606 | B2 | 1/2006 | Brown | |
| 7,051,957 | B1 | 5/2006 | Goenka et al. | |
| 7,082,926 | B2 | 8/2006 | Sadakane et al. | |
| 7,104,475 | B2 | 9/2006 | Goenka et al. | |
| 7,124,963 | B2 | 10/2006 | Goenka et al. | |
| 7,131,600 | B2 | 11/2006 | Stocker | |
| 7,137,577 | B2 | 11/2006 | Goenka et al. | |
| 7,159,800 | B2 | 1/2007 | Peterson, Jr. | |
| 7,168,637 | B2 | 1/2007 | Goenka et al. | |
| 7,185,831 | B2 | 3/2007 | Goenka et al. | |
| 7,198,207 | B2 | 4/2007 | Goenka et al. | |
| 7,249,454 | B2 | 7/2007 | Ichise et al. | |
| 7,249,596 | B2 | 7/2007 | Pellizzari et al. | |
| 7,269,941 | B2 | 9/2007 | Ichise et al. | |
| 7,276,190 | B2 | 10/2007 | Reverchon | |
| 7,318,412 | B2 | 1/2008 | Ito et al. | |
| 7,341,204 | B2 | 3/2008 | Akabane | |
| 7,344,090 | B2 | 3/2008 | Sayar | |
| 2001/0039936 | A1 | 11/2001 | Ichihara et al. | |

* cited by examiner

DUAL ACTION FUEL INJECTION NOZZLE

FIELD OF THE INVENTION

The present disclosure generally relates to fuel injection nozzles, and more particularly to a dual action spill-return/air assist pressure atomizer for an internal combustion engine.

BACKGROUND OF THE INVENTION

Atomization performance is a concern for many applications, including combustion, spray drying, agricultural-pest control and pharmaceutical delivery. Typically, atomization is optimized by producing the smallest drops with the least amount of energy over the widest range of liquid flow rates.

Achieving the best atomization performance from a liquid injector has been addressed in a number of ways, including using pressure-swirl atomizers. Pressure-swirl atomizers, as well as spill-return atomizers, have been known for some time. Spill-return atomizers, although similar in action to pressure-swirl atomizers, provide a wide range of flow rates.

In a spill-return atomizer, such as in a fuel injector, a swirl chamber contains a passage through which liquid can be "spilled" away from the atomizer. The input of fluid into the atomizer and the swirl chamber is under typically a high pressure. The fluid that is not atomized in the swirl chamber recirculates through the spill return to a liquid return or fuel return reservoir.

The apparatus of the present disclosure must be of a construction that is both durable and long lasting, and it should also require little or no maintenance to be provided by the user throughout its operating lifetime. In order to enhance the market appeal of the apparatus of the present disclosure, it should also be of inexpensive construction to thereby afford it the broadest possible market.

The disclosure provides a liquid injection nozzle, a fuel injection system for an internal combustion engine and, a method of increasing atomization performance of a fuel injection nozzle. These and other advantages of the invention, as well as additional inventive features, will be apparent from the disclosure provided herein.

The invention provides such a fuel injection nozzle, a fuel injection system, and a method of increasing atomization performance of a fuel injection nozzle.

BRIEF SUMMARY OF THE INVENTION

In one aspect, the disclosure provides a fuel injection nozzle. The fuel injection nozzle includes a nozzle body, with the nozzle body defining a central bore. A fuel atomizer is disposed in the central bore. The fuel atomizer defines a spill-return bore and a swirl chamber. The swirl chamber is in fluid communication with the central bore. The spill-return bore includes a return swirler approximate the swirl chamber. An air supply pump is coupled to the fuel atomizer and is in fluid communication with the spill-return bore. The air supply pump is configured to selectively inject air into the swirl chamber through the spill-return bore.

In another aspect, the disclosure provides a fuel injection system for an internal combustion engine. The fuel injection system for an internal combustion engine includes a fuel supply and a fuel injection nozzle. The fuel injection nozzle is coupled to the fuel supply. The fuel injection nozzle includes a nozzle body, with the nozzle body defining a central bore. A fuel atomizer is disposed in the central bore. The fuel atomizer defines a spill-return bore and a swirl chamber. The swirl chamber is in fluid communication with the central bore. The spill-return bore includes a return swirler approximate the swirl chamber. An air supply pump is coupled to the fuel atomizer and is in fluid communication with the spill-return bore. The air supply pump is configured to selectively inject air into the swirl chamber through the spill-return bore. The fuel supply is coupled to the nozzle body and is in fluid communication with the central bore.

In yet another aspect, the disclosure provides a method of increasing atomization performance of a fuel injection nozzle. The nozzle includes a nozzle body defining a central bore. A fuel atomizer is disposed in the central bore. The fuel atomizer defines a spill-return bore and a swirl chamber, with the swirl chamber in fluid communication with the central bore. The method includes the steps of coupling an air supply pump to the fuel atomizer, with the air supply pump in fluid communication with the spill-return bore. The method also includes injecting air selectively into the swirl chamber through the spill-return bore, wherein the fuel injection nozzle is changed from pressure-atomization to air-assist atomization.

Other aspects, objectives and advantages of the disclosure will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present disclosure and, together with the description, serve to explain the principles of the matter disclosed. In the drawings.

While the invention will be described in connection with certain preferred embodiments, there is no intent to limit it to those embodiments. On the contrary, the intent is to cover all alternatives, modifications and equivalents as included within the spirit and scope of the appended claims.

DETAILED DESCRIPTION OF EXEMPLARY EMBODIMENTS

This application discloses a combination of a spill-return atomizer concept with an air-assist atomizer concept. A spill-return nozzle requires a fluid return line from the low pressure side of the fuel swirler. The action of this nozzle can be changed from pure-atomization to air-assist atomization (also referred to as air-blast atomization) if the spill-return line is switched over to a high-pressure atomizing line, by directly inserting high-velocity air into the swirl-chamber of the pressure-swirl atomizer.

Additional optimization can be achieved by inserting a return swirler in the spill-return line so that the injected air will be swirled, further improving the atomization while having minimal effect on nozzle performance if the nozzle is in a straight spill-return mode.

Figure 1:
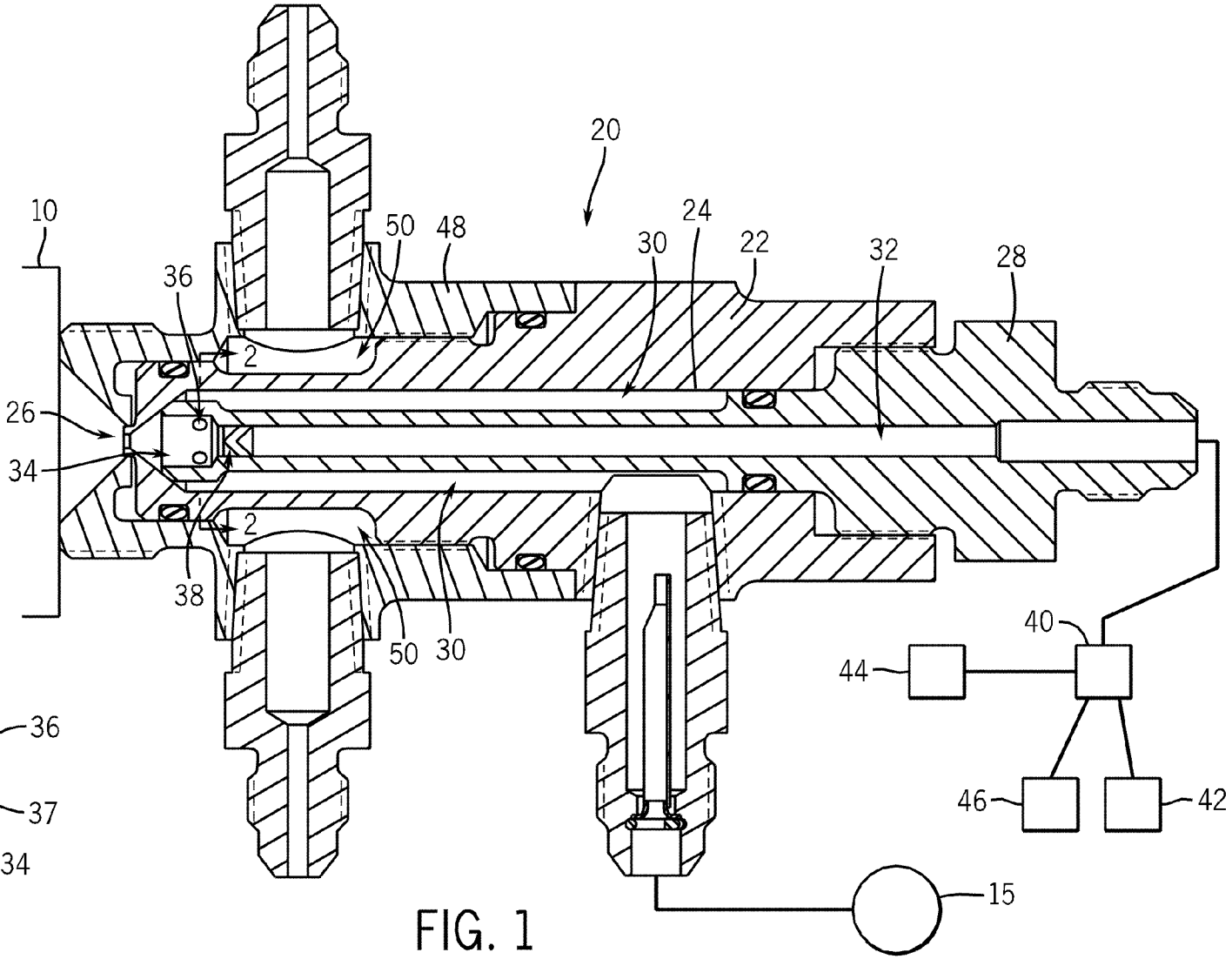
FIG. 1 is a cross-sectional view of an exemplary embodiment of a fuel injection nozzle including a dual action spill-return/air assist pressure atomizer.
Figure 2:
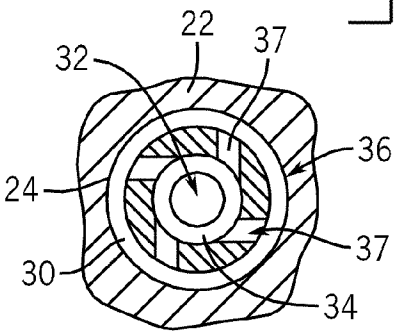
FIG. 2 is a cross-sectional view of a fuel swirler in a fuel atomizer of the fuel injection nozzle illustrated in FIG. 1 along the line 2-2.

Referring to the FIGS. 1 and 2, FIG. 1 illustrates an exemplary embodiment of a dual action spill-return/air-assist pressure fuel injection on nozzle. FIG. 1 is a cross-sectional view along a longitudinal axis of the fuel injection nozzle 20.

The fuel injection nozzle 20 includes a nozzle body 22 with the nozzle body 22 defining a central bore 24. The central bore extends axially through the nozzle body 22. At one end of the nozzle body 22 an exit orifice 26 directs fluid, such as fuel, into an internal combustion engine 10. The internal combustion engine can be of the type used in automobiles and small trucks, i.e. gasoline combustion engine, or a diesel engine, or a gas turbine, such as used in aircraft.

A fuel atomizer 28 is disposed in the central bore 24. The fuel atomizer 28 defines a spill-return bore 32 and a swirl chamber 34. The swirl chamber 34 is in fluid communication with the central bore 24. The spill-return bore 32 includes a return swirler 38 approximate the swirl chamber 34.

An air supply pump 42 is coupled to the fuel atomizer 28 and is in fluid communication with the spill-return bore 32, wherein the air supply pump 42 is configured to selectively inject air into the swirl chamber 34 through the spill-return bore 32. The air supply pump 42 can be any convenient and conventional pump which may include an air reservoir or other suitable air supply.

A fuel supply 15 is coupled to the nozzle body 22 and is in fluid communication with the central bore 24. A fuel port in the nozzle body 22 receives liquid fuel from the fuel supply 15, typically under high pressure, and inputs the fuel a fuel portion 30 of the central bore 24. The fuel enters the swirl chamber 34 through a fuel swirler 36 which includes a plurality of bores 37 defined in the fuel swirler 36. Each bore 37 is in fluid communication with the swirl chamber 34 and the central bore 24 (see FIG. 2). The fuel exits the fuel injection nozzle 20 through the exit 26 as a fine mist as determined by among other things, the geometry of the fuel injection nozzle 20, liquid properties, and the pressure and flow of the fuel through the fuel injection nozzle 20. In such mode, the fuel injection nozzle 20 is in a pure pressure-atomization mode. In other words the fuel flow and pressure governs the atomization of the fuel exiting the fuel injection nozzle 20. In this mode, excess liquid fuel in the swirl chamber 34 is recycled through the spill return bore 32 back to the fuel return reservoir 46. The return fuel is typically recycled.

To change the fuel injection nozzle 20 to an air-assist atomization mode, a switch valve 40 is in fluid communication with the spill-return bore 32 and the air supply pump 42. The switch valve 40 can be of any convenient and conventional valve train which is controlled by a controller 44 coupled to the valve switch 40 and configured to selectively couple the spill-return bore 32 to one of the air supply pump 42 and the fuel return reservoir 46.

When the valve switch 40 couples the air supply pump to the spill-return bore 32 high velocity air is injected into the spill-return bore 32 and into the swirl chamber 34 to mix with the fuel entering the fuel swirler 36 from the central bore 24.

Additional optimization of the fuel injection nozzle can be achieved by including the return swirler 38 in the spill-return bore 32 approximate the swirl chamber 34. The return swirler 38 acts to spin the air to improve the atomization quality of the liquid injector.

In another embodiment of the fuel injection nozzle 20 a cooling jacket 48 is coupled to the nozzle body 22 and configured to provide a cooling fluid to a fluid cooling chamber 50 defined by the cooling jacket 48 and the nozzle body 22. Any suitable and conventional cooling fluid can be injected into the fluid cooling chamber 50 by any convenient means.

In order to reduce machining costs it is contemplated that a seal between the fuel atomizer 28 and the nozzle body 22 can be achieved by forcing the fuel atomizer 28 up against a conical surface defined in the central bore 24 of the nozzle body 22, such conical surface leading to the exit orifice 26. Additional force on the fuel atomizer 28 to effect the seal with the nozzle body 22 can be maintained using a biasing member, such as a spring.

For purposes of this disclosure, the term "coupled" means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

The use of the terms "a" and "an" and "the" and similar referents in the context of describing the disclosure (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the material disclosed and does not pose a limitation on the scope of the invention unless otherwise claimed. No language in the specification should be construed as indicating any non-claimed element as essential to the practice of the subject matter herein.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the subject matter to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by this disclosure unless otherwise indicated herein or otherwise clearly contradicted by context.

What is claimed is:

1. A fuel injection nozzle comprising:

a nozzle body, the nozzle body defining a central bore;

a fuel atomizer disposed in the central bore, the fuel atomizer defining a spill-return bore and a swirl chamber, the swirl chamber in fluid communication with the central bore, the spill-return bore including a return swirler proximate the swirl chamber; and an air supply pump coupled to the fuel atomizer and in fluid communication with the spill-return bore, wherein the air supply pump is configured to selectively inject air into the swirl chamber through the spill-return bore.

2. The fuel injection nozzle of claim 1, including a switch valve in fluid communication with the spill-return bore and the air supply pump.

3. The fuel injection nozzle of claim 2, including a fuel return in fluid communication with the switch valve.

4. The fuel injection nozzle of claim 2, including a controller coupled to the switch valve and configured to selectively couple the spill-return bore to one of the air supply pump and the fuel return.

5. The fuel injection nozzle of claim 1, including a cooling jacket coupled to the nozzle body and configured to provide cooling fluid to a fluid cooling chamber defined by the cooling jacket and the nozzle body.

6. The fuel injection nozzle of claim 1, wherein the swirl chamber includes a fuel swirler.

7. The fuel injection nozzle of claim 6, wherein the fuel swirler includes a plurality of bores defined in the fuel swirler, with each such bore in fluid communication with the swirl chamber and the central bore.

8. The fuel injection nozzle of claim 1, including a fuel supply coupled to the nozzle body and in fluid communication with the central bore.

9. The fuel injection nozzle of claim 1, wherein the fuel injection nozzle is coupled to an internal combustion engine.

10. The fuel injection nozzle of claim 9, wherein the internal combustion engine is a gas turbine.

11. A fuel injection system for an internal combustion engine, comprising:

a fuel supply; and a fuel injection nozzle coupled to the fuel supply, the fuel injection nozzle comprising:

a nozzle body, the nozzle body defining a central bore;

a fuel atomizer disposed in the central bore, the fuel atomizer defining a spill-return bore and a swirl chamber, the swirl chamber in fluid communication with the central bore, the spill-return bore including a return swirler proximate the swirl chamber; and an air supply pump coupled to the fuel atomizer and in fluid communication with the spill-return bore, wherein the air supply pump is configured to selectively inject air into the swirl chamber through the spill-return bore, and wherein the fuel supply is coupled to the nozzle body and in fluid communication with the central bore.

12. The fuel injection system for an internal combustion engine of claim 11, including a switch valve in fluid communication with the spill-return bore and the air supply pump.

13. The fuel injection system for an internal combustion engine of claim 12, including a fuel return in fluid communication with the switch valve.

14. The fuel injection system for an internal combustion engine of claim 12, including a controller coupled to the switch valve and configured to selectively couple the spill-return bore to one of the air supply pump and the fuel return.

15. The fuel injection system for an internal combustion engine of claim 11, including a cooling jacket coupled to the nozzle body and configured to provide cooling fluid to a fluid cooling chamber defined by the cooling jacket and the nozzle body.

16. The fuel injection system for an internal combustion engine of claim 11, wherein the swirl chamber includes a fuel swirler.

17. The fuel injection system for an internal combustion engine of claim 16, wherein the fuel swirler includes a plurality of bores defined in the fuel swirler, with each such bore in fluid communication with the swirl chamber and the central bore.

18. The fuel injection system for an internal combustion engine of claim 11, wherein the internal combustion engine is a gas turbine.

19. A method of increasing atomization performance of a fuel injection nozzle, the nozzle including a nozzle body defining a central bore, a fuel atomizer disposed in the central bore, the fuel atomizer defying a spill-return bore and a swirl chamber, with the swirl chamber in fluid communication with the central bore, the method comprising:

coupling an air supply pump to the fuel atomizer, the air supply pump in fluid communication with the spill-return bore; and injecting air selectively into the swirl chamber through the spill-return bore, wherein the fuel injection nozzle is changed from pressure-atomization to air-assist atomization.

20. The method of increasing atomization performance of a fuel injection nozzle of claim 19, including the step of inserting a return swirler in the spill-return bore proximate the swirl chamber, wherein the return swirler is configured to swirl the injected air.

21. The method of increasing atomization performance of a fuel injection nozzle of claim 19, including a switch valve in fluid communication with the spill-return bore and the air supply pump, wherein air flow into the spill-return bore is selected.

22. The method of claim 19 further including the step of:

injecting fuel into the swirl chamber through a fuel swirler simultaneously with the step of injecting air selectively into the swirl chamber through the spill-return bore, such that the injected fuel and air mix to supply atomized fuel.

23. The fuel injection system of claim 11, wherein the fuel injection system is configured such that the fuel supply and air supply pump are configured to simultaneously inject fuel and air into the swirl chamber to form a mixture of atomized air and fuel to be supplied to the internal combustion engine to power, continuously, the internal combustion engine.

* * * * *

UNITED STATES PATENT AND TRADEMARK OFFICE

CERTIFICATE OF CORRECTION

PATENT NO. : 9,291,139 B2
APPLICATION NO. : 12/199404
DATED : March 22, 2016
INVENTOR(S) : Paul G. Hicks et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1991 days.

Signed and Sealed this
Twenty-sixth Day of July, 2016

Michelle K. Lee

Michelle K. Lee
*Director of the United States Patent and Trademark Office*